US006821183B2

(12) United States Patent
Blackman et al.

(10) Patent No.: US 6,821,183 B2
(45) **Date of Patent: *Nov. 23, 2004**

(54) CURRENT CONTROLLER FOR AN EMBEDDED ELECTRONIC MODULE

(75) Inventors: John A. Blackman, Boca Raton, FL (US); Melchiore (Mike) Tripoli, III, Pittsburgh, PA (US)

(73) Assignee: Sing-A-Toon Balloons, LLC, Boca Raton, FL (US)

( * ) Notice: Subject to any disclaimer, the term of this patent is extended or adjusted under 35 U.S.C. 154(b) by 16 days.

This patent is subject to a terminal disclaimer.

(21) Appl. No.: 09/849,735

(22) Filed: May 4, 2001

(65) Prior Publication Data

US 2002/0164919 A1 Nov. 7, 2002

(51) Int. Cl.[7] ..... A63H 3/06; F21V 33/00
(52) U.S. Cl. ..... 446/220; 446/224; 362/96
(58) Field of Search ..... 446/220–226, 446/485; 362/806, 253, 802, 96, 276

(56) References Cited

U.S. PATENT DOCUMENTS

| | | | | | |
|---|---|---|---|---|---|
| 3,478,343 | A | * | 11/1969 | Wallace | 340/566 |
| 3,649,789 | A | * | 3/1972 | Stoll | 200/82 R |
| 3,740,543 | A | | 6/1973 | Franc | |
| 4,464,861 | A | | 8/1984 | Fogarty et al. | |
| 4,704,934 | A | | 11/1987 | Nosrati | |
| 4,823,907 | A | * | 4/1989 | Hoshi | 181/148 |
| 5,054,778 | A | | 10/1991 | Maleyko | |
| 5,108,338 | A | | 4/1992 | Margolis | |
| 5,215,492 | A | | 6/1993 | Kubiatowicz | |
| 5,254,007 | A | * | 10/1993 | Eagan | 434/319 |
| 5,609,411 | A | | 3/1997 | Wang | |
| 5,669,702 | A | | 9/1997 | Wang | |
| 5,725,445 | A | | 3/1998 | Kennedy et al. | |
| 5,782,668 | A | | 7/1998 | Chabert | |
| 5,893,798 | A | * | 4/1999 | Stambolic et al. | 463/46 |
| 6,012,826 | A | * | 1/2000 | Chabert | 362/363 |
| 6,238,067 | B1 | | 5/2001 | Hirsch | |
| 6,482,065 | B1 | * | 11/2002 | Blackman | 446/220 |

OTHER PUBLICATIONS

U.S. patent application, Ser. No. 09/522,123, Filing Date Mar. 9, 2000, First Named Inventor Blackman, John A. entitled Inflatable Object that Contains a Module That is inaccessible From the Outside but Which Becomes Powered in Response to Inflation of the Object.

* cited by examiner

*Primary Examiner*—Jacob K. Ackun
*Assistant Examiner*—Faye Francis
(74) *Attorney, Agent, or Firm*—Gibbons, Del Deo, Dolan, Griffinger & Vecchione

(57) ABSTRACT

The invention provides a circuit embedded within a Mylar balloon for providing a desired effect such as sound, illumination, or both. The circuit includes a switch for preventing premature discharge of the power source and a tab for closing the switch when the balloon is inflated.

15 Claims, 3 Drawing Sheets

CURRENT CONTROLLER FOR AN EMBEDDED ELECTRONIC MODULE

CROSS-REFERENCE TO RELATED PATENT APPLICATIONS

STATEMENT REGARDING FEDERALLY SPONSORED RESEARCH OR DEVELOPMENT

Not Applicable.

BACKGROUND OF THE INVENTION

The present invention relates generally to electrical insulators and more particularly to a removable insulator for minimizing or preventing current drain from an energy source used in an electric circuit embedded within an inflatable device.

Battery powered electric circuits are used in may devices to emit sounds, turn lights on and off, display messages, display time, etc. However, a common problem with these devices is current drain from the power supply (typically batteries) while the device is not in use (e.g. while in transit from the manufacturer to the consumer, etc.). Thus, the batteries may be dead or weakened by the time the consumer receives the device.

With non-embedded electric circuits, the batteries may be replaced by the consumer and/or current drain may be prevented with a manually operated on/off switch. Further, methods have been proposed, that include limiting the current drawn by the circuit. However, limiting the current may limit the volume of the sound emitted and/or the brightness of the illumination emitted. Additionally, many electronic products today, especially children's toys are sold with a battery "pull-tab". This is essentially an insulating material that is inserted between the battery and the battery contacts to prevent circuit completion, and thus to prevent current leakage. After the toy is removed from the packaging, the pull-tab is manually removed by either the child or an adult, the circuit is completed and the toy may be used.

These types of solutions, however, may be impractical in circuits that are inaccessible in devices such as inflatables (e.g. balloons, beach balls, air mattresses, dolls, instruments, etc.).

Accordingly, it would be advantageous to provide an apparatus that minimizes or prevents current drain from a power source, prior to inflating the inflatable device in which the power source is embedded. It would be further advantageous to provide such an apparatus that minimizes or prevents current drain from a power source that is embedded within an inflatable device when the device is not inflated. It would be another advantage to provide such an apparatus that is automatically repositioned to allow current flow from the power source. It would be still another advantage to provide such an apparatus that does not limit the current flow during normal operation of the circuit.

BRIEF SUMMARY OF THE INVENTION

An aspect of the invention provides an apparatus for impeding current flow in a circuit. The apparatus includes an inflatable device that has an interior surface. The apparatus also includes a circuit that has at least a power source and a switch electrically connected with the power source. The circuit is attached to the interior surface. The switch has an open position which prevents current from flowing from the power source, and a closed position which allows current to flow from the power source through the circuit. The apparatus also includes a tab having a proximal portion and a distal portion. The proximal portion of the tab is placed in contact with the switch and the distal portion of the tab is connected to the inflatable device. The tab is also arranged to move relative to the switch and to change the position of the switch from the open position to the closed position as the apparatus is inflated.

Another aspect of the invention provides a method of preventing premature discharge of a power source. The method includes connecting a circuit, which includes at a minimum, a power source and a switch electrically connected to the power source, to a portion of an interior wall of an inflatable device. The method also includes placing the switch in an open circuit position and configuring the switch to automatically change to a closed circuit position as the inflatable device is inflated.

Still another aspect of the invention provides an inflatable apparatus that includes a shell having an interior portion. The apparatus also includes a circuit connected to the interior portion. The circuit includes an energy source and a switch electrically connected to the energy source. The switch has an open circuit position and a closed circuit position. The apparatus further includes a tab connected between the shell and the circuit. The tab is arranged to change the switch position from the open circuit position to the closed circuit position as the inflatable device is inflated.

Yet another aspect of the invention provides an inflatable apparatus that includes a shell having an interior portion, a circuit module connected to the shell for generating a desired effect, and a module connected to the circuit module for preventing the circuit module from generating the desired effect until the inflatable apparatus is being inflated.

Another aspect of the invention provides an inflatable Mylar balloon. The balloon includes at least two sheets each having an edge and an interior side. The sheets are connected together at their edges. The balloon also includes a sound producing circuit that includes batteries, a switch electrically connected to the batteries and a piezoelectric noise generator electrically connected to the switch. The switch is operable between an open circuit position and a closed circuit position. The circuit is mechanically connected to the interior side of one of the sheets. The balloon also includes a tab connected to the switch and configured to change the switch from the open circuit position to the closed circuit position.

The invention will next be described in connection with certain illustrated embodiments and practices. However, it will be clear to those skilled in the art that various modifications, additions and subtractions can be made without departing from the spirit or scope of the claims.

BRIEF DESCRIPTION OF THE FIGURES

The invention will be more clearly understood by reference to the following detailed description of an exemplary embodiment in conjunction with the accompanying drawings, in which.

DETAILED DESCRIPTION OF THE INVENTION

The present invention provides a circuit embedded within an inflatable device for providing a desired effect. The circuit can be one which causes sounds (e.g. music, random sounds, single tones, etc.), one which actuates illumination, or one which causes sounds and actuates illumination. The inflatable device may be a balloon, beach ball, air mattress, doll, instrument, tube, or any other inflatable device. The circuit includes a switch for minimizing or preventing premature drain of a power source of the circuit. The terms minimizing and preventing may be used interchangeably herein. Both terms shall be understood to cover the configurations of merely lessening or completely stopping current flow from the power source. The switch is configured to close as the inflatable device is inflated or upon the inflatable device reaching a desired level of inflation.

Figure 1:
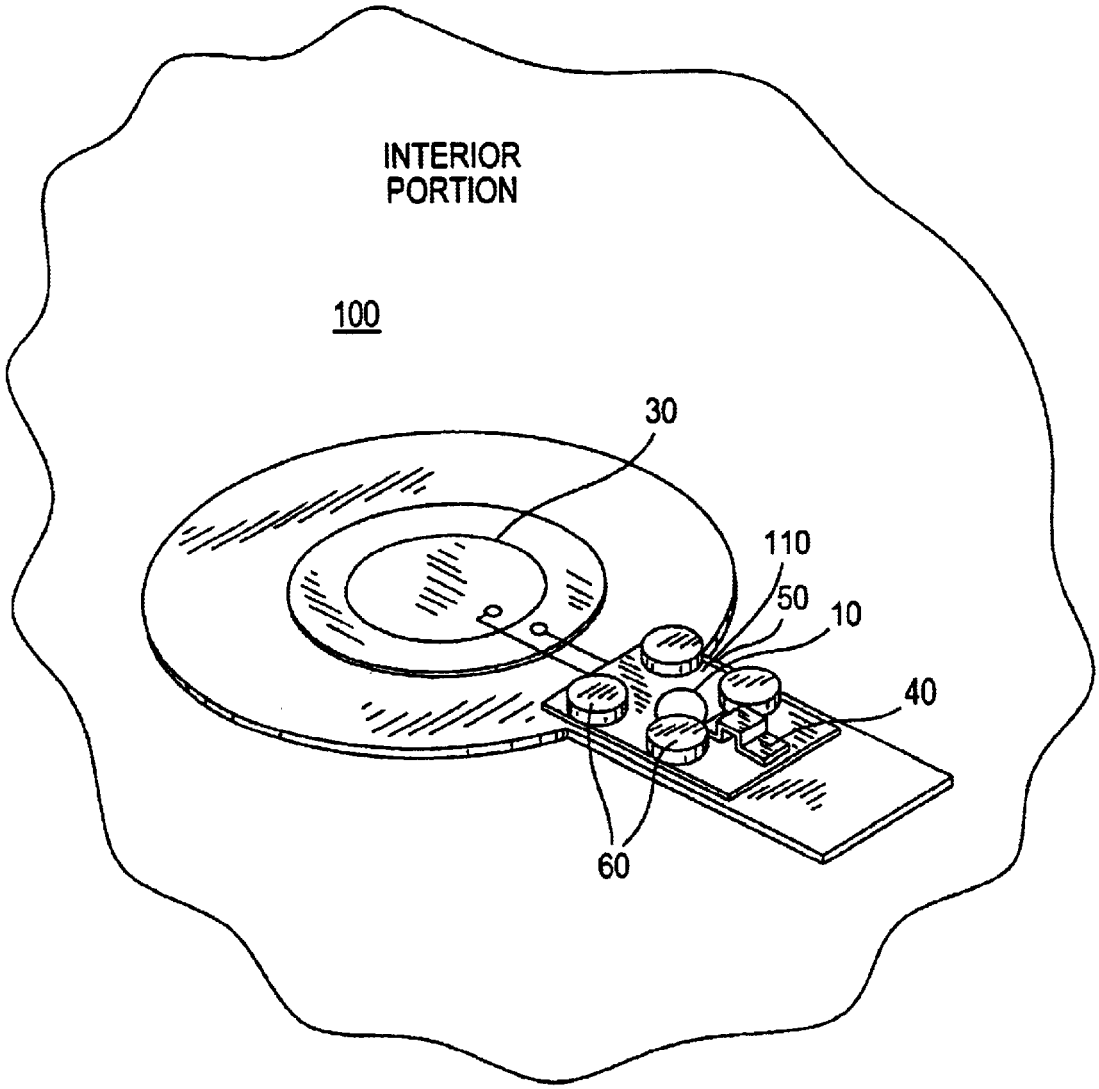
FIG. 1 is an isometric view of an electric circuit in accordance with the invention that can be embedded within an inflatable device.

FIG. 1 illustrates an embodiment of the invention including a sound producing circuit 100. The circuit 100 includes a piezoelectric device 30 and other circuit elements 10 powered by batteries 60. Conventional circuits exist for the production of sound and illumination, thus, the design of the "other circuit elements" to produce the desired sound or illumination result will not be discussed further. Various circuit designs for a desired effect could be designed by an electrical engineering student taking a basic level, logic design course with minimal experimentation. Further, while batteries are illustrated, any power source that is sufficient for the purpose of powering the circuit 110 may be employed without departing from the scope of the invention.

Figure 2:
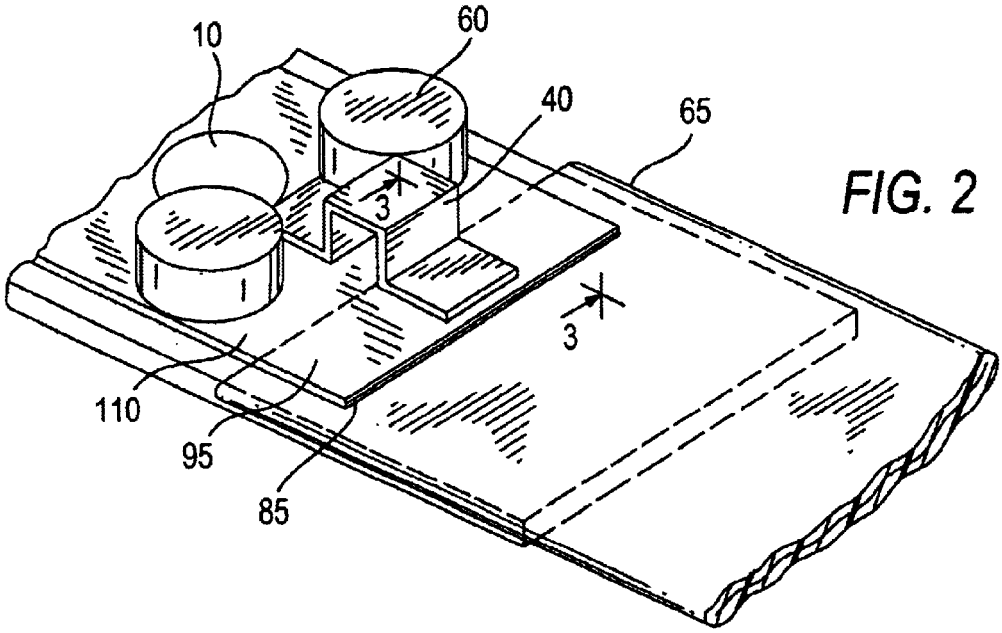
FIG. 2 is an isometric view of the electric circuit of FIG. 1 illustrating a battery isolator switch and an insulator positioned within the switch.
Figure 3:
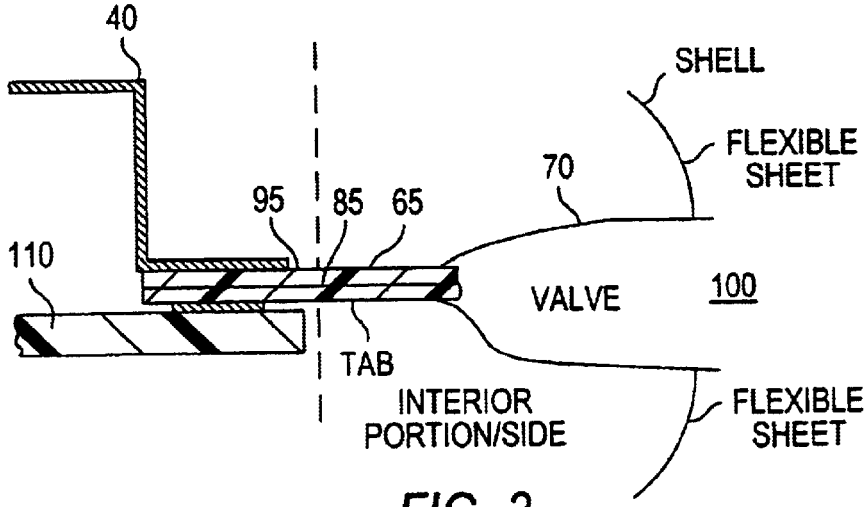
FIG. 3 is a side view of the battery isolator switch of FIG. 2 illustrating the position of the insulator to minimize current drain from the battery.
Figure 4:
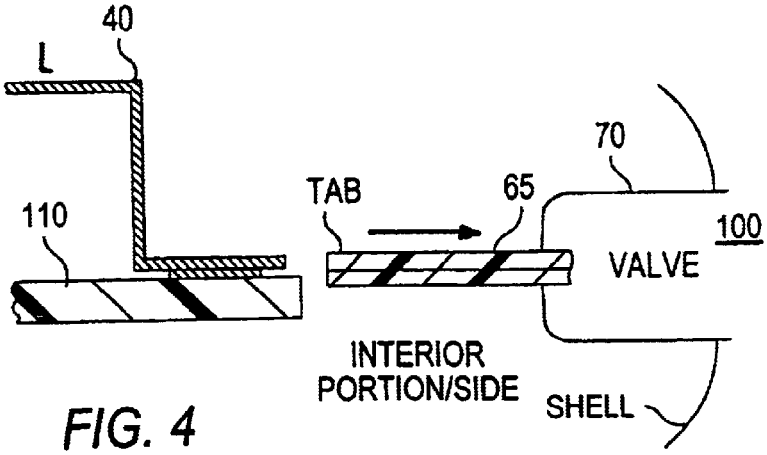
FIG. 4 is a side view of the battery isolator switch of FIG. 2 illustrating the insulator being removed from the battery isolator switch to allow current flow.

The circuit 100 also includes a switch 40 which has at least two positions, open circuit (open) and closed circuit (closed). Those skilled in the art will recognize that a switch could be designed that allows partial current flow without departing from the scope of the invention. In the open circuit position illustrated in FIG. 3, the switch 40 opens the circuit 110 thus preventing the batteries 60 from discharging. In the closed circuit position illustrated in FIG. 4, the switch 40 closes the circuit 110 and thus allows the current to flow from the batteries 60 and power the circuit 110 for the desired effect. As illustrated in FIGS. 2, 3, and 4, a type of switch 40 includes an insulating material 65 (also referred to as a tab) placed within switch 40 to ensure that switch 40 remains in the open circuit position. It is not until insulating material 65 is removed from the switch 40, as illustrated in FIG. 4, that the switch 40 is allowed to move into its closed circuit position. The switch 40 moves to the closed circuit position when the insulating material 65 is removed because the switch 40 is biased towards the closed circuit position. It is this bias that connects the insulating material 65 to the switch 40.

Figure 5:
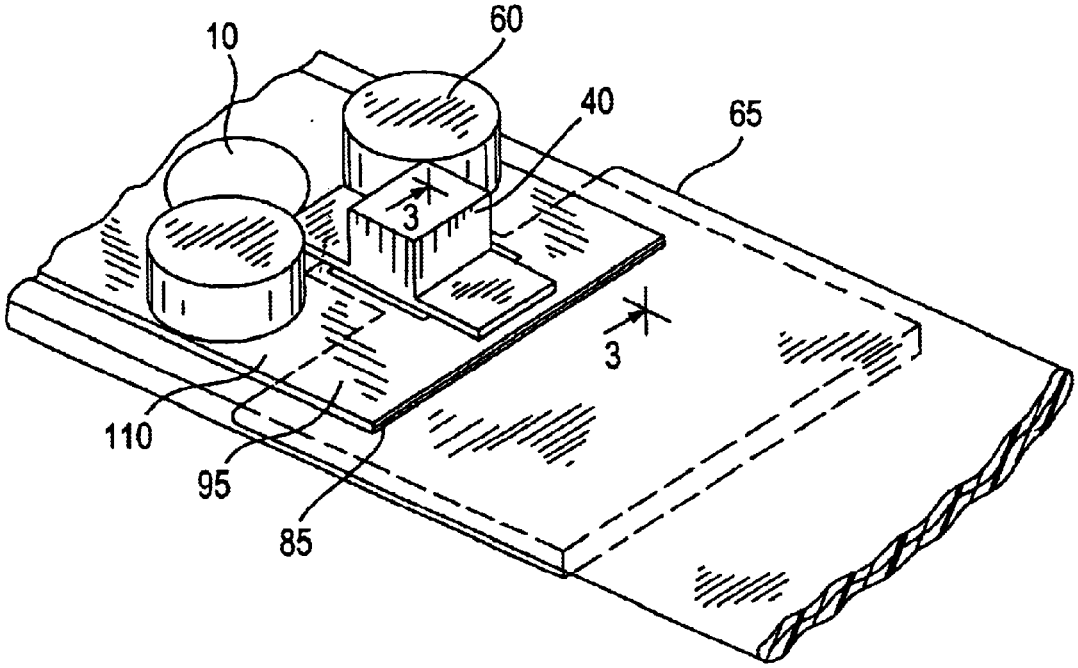
FIG. 5 is an isometric view of an alternate embodiment of the invention.

In an alternate configuration illustrated in FIG. 5, the switch 40 may be a sliding switch 40 that slides from an open circuit position to a closed circuit position. In this embodiment, the insulating material 65 need not be an insulator, although it could be. Instead insulating material 65 is either attached to the switch 40 or surrounds the switch 40 in such a way as to be able to move the switch 40 from the open position to the closed position.

Other types of alternative switches 40 that may be employed include pressure switches 40 (not shown), which change position as the pressure in the inflatable changes, ball and cage switches 40 (not shown), wherein the ball is held in place by insulating material 65 until insulating material 65 is either removed or moves the ball, etc.

When the circuit 110 is embedded within the inflatable device 100, it is either attached to an interior wall of the inflatable device 100, or it is attached to a piece of material that is attached to an interior wall of the device (not shown). In either event, the insulating material 65 is attached on one side to the inflatable device 100 and on the other to the switch 40. The insulating material 65 is attached in such a way that when the inflatable device 100 is inflated it causes the insulating material 65 to move relative to the switch 40. The end or some other portion of the insulating material 65 that is not connected to the switch 40 may be connected to an interior wall of the inflatable device 100, to a valve 70 in the inflatable device 100, to both the valve 70 and the interior wall or to two points on the interior surface of the inflatable device 100. In the embodiment wherein the insulator material 65 is connected to the inflatable device 100 in two locations, the insulator material 65 could be flexible such that as the device inflates, the insulating material 65 is removed (entirely or partially so long as the circuit closes) from the switch 40 and when the device deflates the insulating material 65 is returned to the switch 40 to re-open the circuit.

In a preferred embodiment of the invention, the circuit 110 is embedded within a Mylar balloon 100. Mylar balloons are generally formed from a valve assembly 70 and two flexible sheets that are cut into patterns and sealed together. The valve assembly 70 is typically formed from two lengths of polyethylene or polypropylene (although not required to be this material), heat bonded along the longer edges. During manufacture of the balloon 100, a "pick and place" machine tack-welds the valve in place against one of the flexible sheets. The outer edges of the flexible sheets are then heat sealed to form the balloon 100.

The circuit 110 may also be tack-welded (or glued or attached in some other suitable manner) to one of the flexible sheets of the balloon 100 during manufacture. Further, during manufacture, a portion of the insulating material 65 is placed within switch 40 and a distal portion of the insulating material may be tack-welded or glued to the valve 70. It will be apparent to those skilled in the art that there are other methods of attaching the circuit 110 and insulator material 65 to the balloon 100 without departing from the scope of the invention.

The Mylar balloon 100, now embedded with the circuit 110 may be shipped according to industry shipping practices. Referring to FIGS. 3 and 4, upon inflation of the Mylar balloon 100, the walls of the balloon 100 expand and move relative to the valve 70. Because the insulating material 65 is of a fixed length, and is attached to the valve 70 of the balloon 100, the insulating material 65 is forced to move away from its insulating position into a non-insulating position, thereby positioning the switch 40 into the closed circuit position. In this fashion, the energy in the batteries 60 is preserved until such time that the balloon 100 is sufficiently inflated thereby moving the insulating material 65 out of the switch 40. If the circuit 110 is connected to one sheet of the balloon 100 and the distal portion of the insulating material 65 is connected to the other sheet of the balloon 100, or possible another portion of the same sheet, the result would be the same as the balloon 100 inflates.

In the embodiment employing the sliding switch 40 (FIG. 5), the insulating material 65 will slide the switch 40 from the open position to the closed position as it moves with the balloon 100.

In another embodiment the insulating material 65 or a portion thereof forms the valve 40 of the balloon 100. In this embodiment, one portion of the insulator material 65/valve 70 is attached to the balloon 100 and another portion is positioned within the switch 40.

In another alternate embodiment of the invention, the insulating material 65 may extend through the valve 70 of the inflatable device 100 to allow the switch 40 to be manual operated.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall there between.

Having described the invention, what is claimed is:

1. Apparatus for minimizing current flow in a circuit, said apparatus comprising:

an inflatable device having an interior surface;

a circuit comprising a power source and a switch electrically coupled to said power source, said circuit being coupled to said interior surface;

wherein said switch has an open position which prevents current from flowing from said power source, and a closed position which allows current to flow from said power source through said circuit;

a tab having a proximal portion and a distal portion;

wherein said proximal portion of said tab is in contact with said switch and said distal portion of said tab is coupled to said inflatable device;

wherein said tab is arranged to move relative to said switch and to change said position of said switch from said open position to said closed position upon inflation of said inflatable device, and said tab forms a valve in said inflatable device.

2. The apparatus according to claim 1 wherein said power source comprises a battery.

3. The apparatus according to claim 2 further comprising:

a plurality of batteries;

wherein said switch is electrically coupled to each of said plurality of batteries.

4. The apparatus according to claim 1 wherein:

said inflatable device comprises a Mylar balloon.

5. The apparatus according to claim 1 wherein:

said circuit further includes a piezoelectric sound generator electrically coupled to said switch.

6. The apparatus according to claim 1 wherein:

said distal portion of said tab is coupled to said interior surface.

7. The apparatus according to claim 1, wherein said tab is arranged to move relative to said switch and to change said position of said switch from said closed position to said open position upon deflation of said inflatable device.

8. The apparatus according to claim 1, wherein said switch is a sliding switch and includes a contact;

wherein switch is in said closed position when said sliding switch is touching said contact and in said open position when said sliding switch is not touching said contact.

9. The apparatus according to claim 8, wherein said tab is attached to said sliding switch; and wherein said tab is configured to move said sliding switch to a position to touch said contact upon inflation of said inflatable device.

10. Apparatus for minimizing current flow in a circuit, said apparatus comprising:

an inflatable device having an interior surface;

a circuit comprising a power source and a switch electrically coupled to said power source, said circuit being coupled to said interior surface;

wherein said switch has an open position which prevents current from flowing from said power source, and a closed position which allows current to flow from said power source through said circuit;

a tab having a proximal portion and a distal portion;

wherein said proximal portion of said tab is in contact with said switch and said distal portion of said tab is coupled to said inflatable device;

wherein said tab is arranged to move relative to said switch and to change said position of said switch from said open position to said closed position upon inflation of said inflatable device, said inflatable device includes a valve; and, wherein said distal portion of said tab is coupled to said valve.

11. An inflatable Mylar balloon comprising:

a plurality of sheets having an edge and an interior side;

said sheets being coupled together at said edges;

a sound producing circuit comprising a plurality of batteries, a switch electrically coupled to said plurality of batteries and a piezoelectric noise generator electrically coupled to said switch;

wherein said switch is operable between an open circuit position and a closed circuit position;

said circuit being mechanically coupled to said interior side of one of said plurality of sheets;

a tab coupled to said switch and configured to change said switch from said open circuit position to said closed circuit position, and said tab comprises a valve configured to allow air into the Mylar balloon.

12. The Mylar balloon according to claim 11 wherein:

said tab is further coupled to said interior side of one of said plurality of sheets and is arranged to automatically change said switch from said open circuit position to said closed circuit position as the Mylar balloon is inflated.

13. The Mylar balloon according to claim 11 further comprising a valve coupled between said plurality of sheets and configured to allow air into the Mylar balloon.

14. The Mylar balloon according to claim 13 wherein:

said tab is further coupled to said valve and is arranged to automatically change said switch from said open circuit position to said closed circuit position as the Mylar balloon is inflated.

15. The Mylar balloon according to claim 13 wherein:

said tab is arranged to extend through said valve and enables a manual change of said switch position from said open circuit position to said closed circuit position.

* * * * *